US009005751B2

(12) United States Patent
Fujimura et al.

(10) Patent No.: US 9,005,751 B2
(45) Date of Patent: Apr. 14, 2015

(54) FIBERS COMPRISING NANODIAMOND AND PLATINUM NANOCOLLOID, AND BEDDING FORMED THEREBY

(75) Inventors: Tadamasa Fujimura, Yokohama (JP); Taichi Nakamura, Odawara (JP); Shigeru Shiozaki, Machida (JP)

(73) Assignees: Venex Co., Ltd, Kanagawa (JP); Vision Development Co., Ltd, Tokyo (JP)

( * ) Notice: Subject to any disclaimer, the term of this patent is extended or adjusted under 35 U.S.C. 154(b) by 0 days.

(21) Appl. No.: 12/304,932

(22) PCT Filed: Sep. 12, 2008

(86) PCT No.: PCT/JP2008/066566

§ 371 (c)(1), (2), (4) Date: Mar. 20, 2009

(87) PCT Pub. No.: WO2009/041302

PCT Pub. Date: Apr. 2, 2009

(65) Prior Publication Data

US 2010/0200800 A1 Aug. 12, 2010

(30) Foreign Application Priority Data

Sep. 28, 2007 (JP) ..... 2007-256728

(51) Int. Cl.

| | |
|---|---|
| ***B32B 19/00*** | (2006.01) |
| ***B05D 1/16*** | (2006.01) |
| ***C09K 5/00*** | (2006.01) |
| ***A47G 9/00*** | (2006.01) |
| ***A47G 9/02*** | (2006.01) |
| ***D01F 1/10*** | (2006.01) |
| ***D01F 2/08*** | (2006.01) |
| ***D06M 11/74*** | (2006.01) |
| ***D06M 11/83*** | (2006.01) |
| ***D06M 23/08*** | (2006.01) |

(52) U.S. Cl.

CPC *A47G 9/007* (2013.01); *A47G 9/02* (2013.01); *D01F 1/10* (2013.01); *D01F 2/08* (2013.01); *D06M 11/74* (2013.01); *D06M 11/83* (2013.01); *D06M 23/08* (2013.01)

(58) Field of Classification Search

CPC ..... D06M 11/74; D06M 11/83
USPC ..... 428/702, 357; 252/71; 427/462
See application file for complete search history.

(56) References Cited

U.S. PATENT DOCUMENTS

| | | | | |
|---|---|---|---|---|
| 4,741,918 | A * | 5/1988 | Nagy de Nagybaczon et al. | 427/11 |
| 6,041,801 | A | 3/2000 | Gray et al. | |
| 2004/0202899 | A1 * | 10/2004 | Komuro | 428/702 |

(Continued)

FOREIGN PATENT DOCUMENTS

| | | | |
|---|---|---|---|
| EP | 0 582 769 | A1 | 2/1994 |
| EP | 1 291 405 | A1 | 3/2003 |

(Continued)

OTHER PUBLICATIONS

Machine Translation of JP-2006274486 A and JP-2003081768 A.*

(Continued)

*Primary Examiner* — Jeremy R. Pierce
*Assistant Examiner* — Ricardo E Lopez
(74) *Attorney, Agent, or Firm* — Sughrue Mion, PLLC

(57) ABSTRACT

Fibers containing nano-sized diamond and platinum nanocolloid, and bedding formed thereby.

6 Claims, 5 Drawing Sheets

(56) References Cited

U.S. PATENT DOCUMENTS

| | | | | |
|---|---|---|---|---|
| 2004/0225049 | A1 | 11/2004 | Komuro | |
| 2008/0170982 | A1 | 7/2008 | Zhang et al. | |
| 2009/0061210 | A1 * | 3/2009 | Ruuttu et al. | 428/328 |

FOREIGN PATENT DOCUMENTS

| | | | |
|---|---|---|---|
| JP | 03-051301 | A | 3/1991 |
| JP | 03-190990 | A | 8/1991 |
| JP | 3026650 | U | 5/1996 |
| JP | 3042096 | U | 7/1997 |
| JP | 2002-161429 | A | 6/2002 |
| JP | 2003-081768 | A | 3/2003 |
| JP | 2003081768 | A * | 3/2003 |
| JP | 2006-274486 | A | 10/2006 |
| JP | 2006274486 | A * | 10/2006 |
| JP | 3133706 | U | 6/2007 |
| JP | 2008-106392 | A | 5/2008 |
| KR | 2007083399 | A * | 8/2007 |
| WO | 03/103690 | A1 | 12/2003 |

OTHER PUBLICATIONS

Machine translation of KR 20070083399 A, Aug. 2007.*

European Search Report dated Jul. 1, 2010.

Japanese Office Action issued in corresponding Japanese Patent Application No. 10-2008-7031243, dated Apr. 20, 2011.

* cited by examiner

FIBERS COMPRISING NANODIAMOND AND PLATINUM NANOCOLLOID, AND BEDDING FORMED THEREBY

CROSS REFERENCE TO RELATED APPLICATIONS

This application is a National Stage of International Application No. PCT/JP2008/66566filed Sep. 12, 2008, claiming priority based on Japanese Patent Application No. 2007-256728 filed Sep. 28, 2007, the contents of all of which are incorporated herein by reference in their entirety.

FIELD OF THE INVENTION

The present invention relates to fibers containing nano-sized diamond and platinum nanocolloid, bedding, and a method for producing such fibers.

BACKGROUND OF THE INVENTION

Far-infrared rays having a wavelength of about 3-1000 μm give energy (vibration of C—C bonds, C—O bonds, C—H bonds, etc.) to substance molecules to warm the substance. Because the far-infrared rays penetrate relatively deep into the substance, they can elevate the temperature inside the substance without elevating the surface temperature more than needed. Development has conventionally been conducted to provide fibers, clothing, bedding, etc. having excellent temperature-keeping properties utilizing such warming effect of far-infrared rays. The warming effect of far-infrared rays can be obtained by adding far-infrared-radiating components to fibers.

As a technology concerning fibers containing a component having far-infrared radiation properties, JP 3-51301 A discloses underwear having a far-infrared radiation layer containing particles of alumina, zirconia, magnesia, etc. having a far-infrared emissivity of 65% or more on average at 30° C. JP 3-190990 A discloses synthetic fibers containing far-infrared radiation particles comprising alumina, titanium and platinum. However, these far-infrared radiation particles do not have sufficiently high far-infrared radiation properties, and demand is mounting for far-infrared radiation particles having higher irradiating efficiency.

JP 2002-161429 A discloses rayon fibers formed by wet-spinning a solution in which particles of at least one metal oxide selected from the group consisting of alumina, silica, magnesia, calcium oxide and titanium dioxide, and platinum particles are dispersed. Because the particles are contained in the fibers without likelihood of detachment, wearing the underwear formed by such rayon fibers increases blood flow. However, the above far-infrared radiation particles do not have satisfactory far-infrared radiation properties. Accordingly, further improvement in the warming effect is desired.

OBJECT OF THE INVENTION

Accordingly, an object of the present invention is to provide fibers having an excellent far-infrared radiation effect, and inexpensive bedding comprising such fibers.

DISCLOSURE OF THE INVENTION

As a result of extensive investigation in view of the above object, the inventors have found that the addition of nano-sized diamond and platinum nanocolloid provides fibers with extremely improved far-infrared radiation properties. The present invention has been completed based on such findings.

Thus, the fibers of the present invention contain nano-sized diamond and platinum nanocolloid.

0.01 mg or more of the nano-sized diamond and 0.0001 mg or more of the platinum nanocolloid are preferably contained in 1 kg of the fibers.

3 mg or more of the nano-sized diamond and 0.03 mg or more of the platinum nanocolloid are preferably contained in 1 kg of the fibers.

1 g or less of the nano-sized diamond and 10 mg or less of the platinum nanocolloid are preferably contained in 1 kg of the fibers.

0.1 g or less of the nano-sized diamond and 1 mg or less of the platinum nanocolloid are preferably contained in 1 kg of the fibers.

The amount of the platinum nanocolloid is preferably 1/1000 to 1/1 of that of the nano-sized diamond.

The fibers of the present invention are preferably coated with the diamond and the platinum nanocolloid.

The diamond and the platinum nanocolloid are preferably blended in the fibers of the present invention.

The nano-sized diamond preferably has a density of 2.63-3.38 g/cm$^3$.

The bedding of the present invention comprises the fibers of the present invention.

DESCRIPTION OF THE BEST MODE OF THE INVENTION

Figure 1:
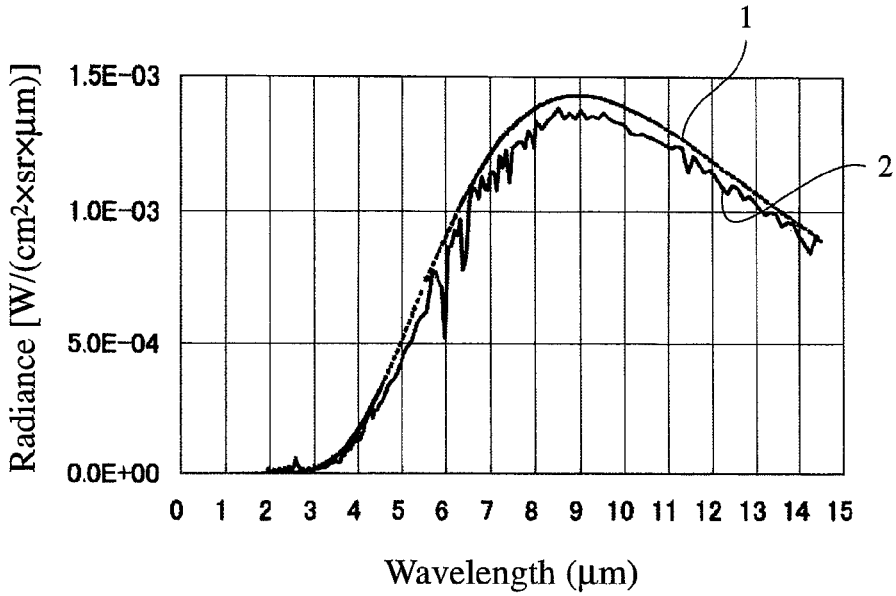
FIG. 1 is a graph showing the far-infrared radiance of the sample of Example 1 and an ideal black body.
Figure 2:
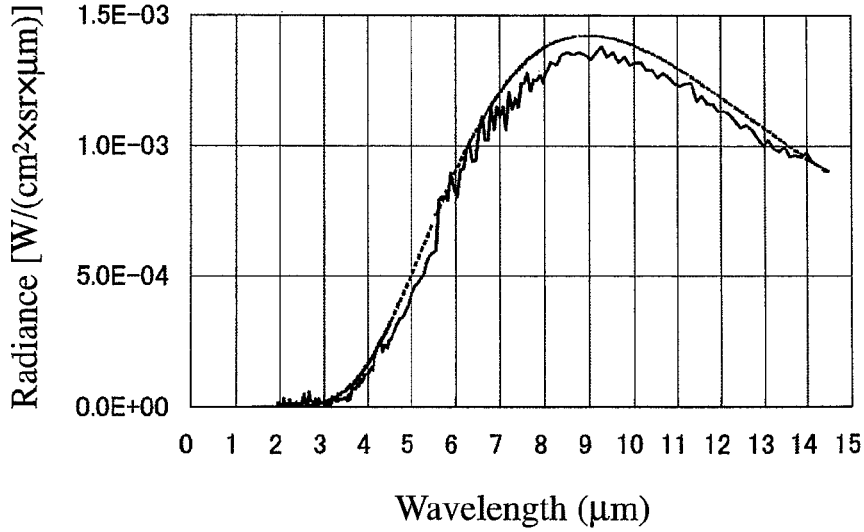
FIG. 2 is a graph showing the far-infrared radiance of the sample of Example 2 and an ideal black body.
Figure 3:
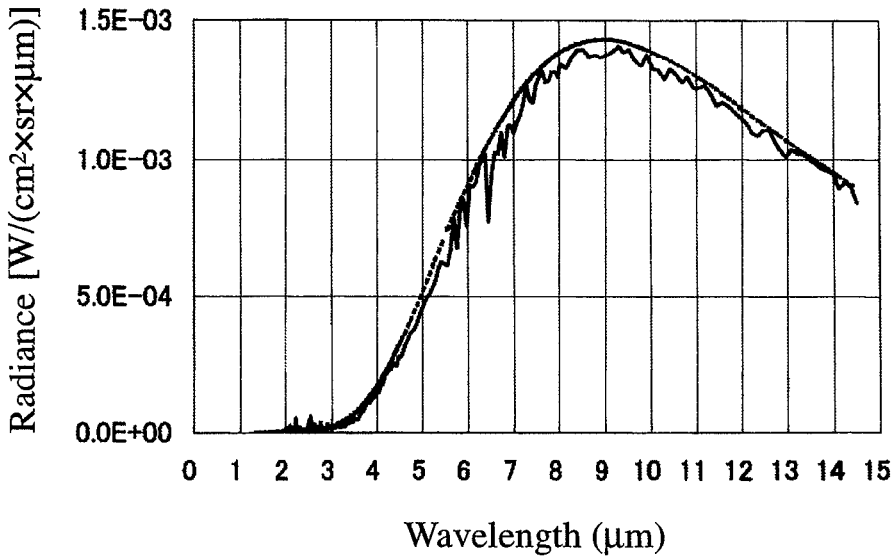
FIG. 3 is a graph showing the far-infrared radiance of the sample of Example 3 and an ideal black body.
Figure 4:
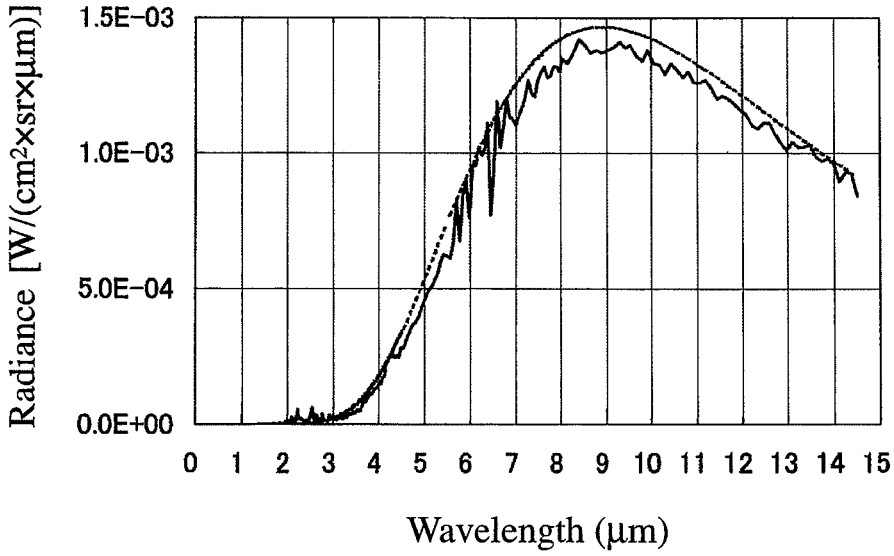
FIG. 4 is a graph showing the far-infrared radiance of the sample of Example 4 and an ideal black body.
Figure 5:
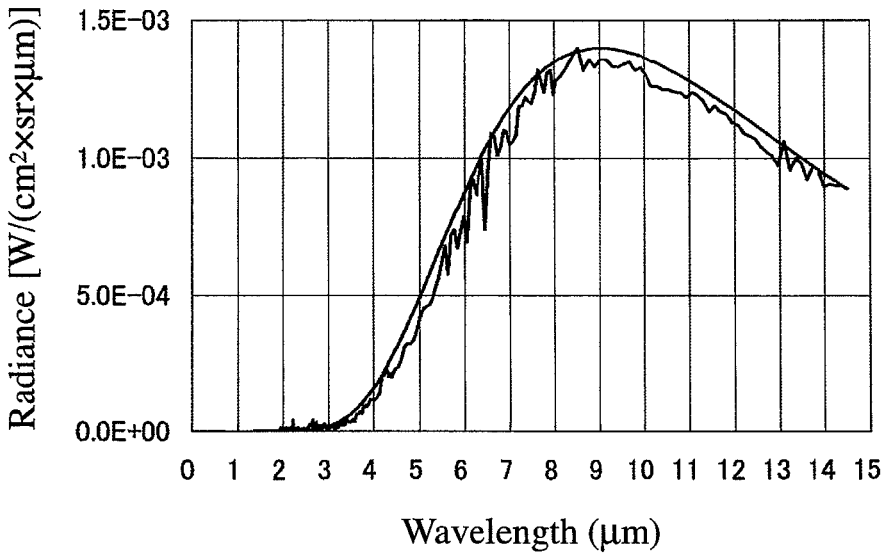
FIG. 5 is a graph showing the far-infrared radiance of the sample of Example 5 and an ideal black body.
Figure 6:
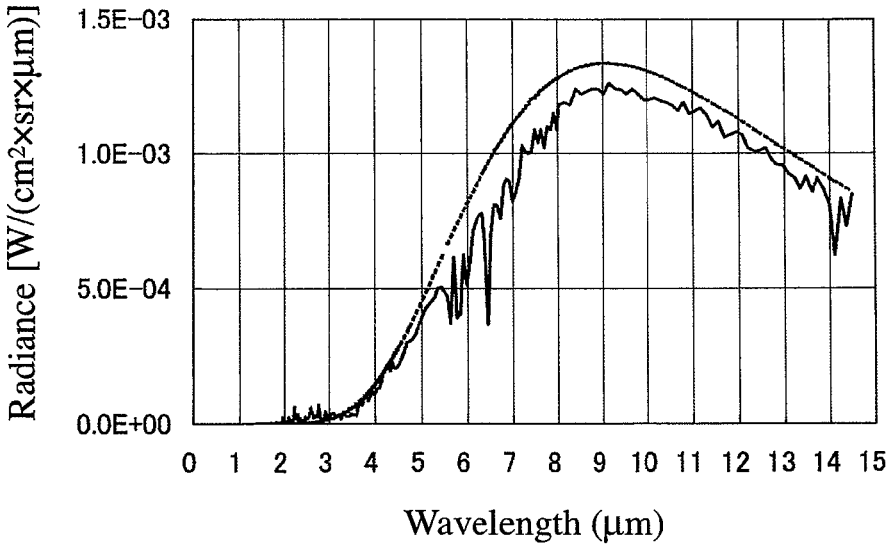
FIG. 6 is a graph showing the far-infrared radiance of the sample of Comparative Example 1 and an ideal black body.
Figure 7:
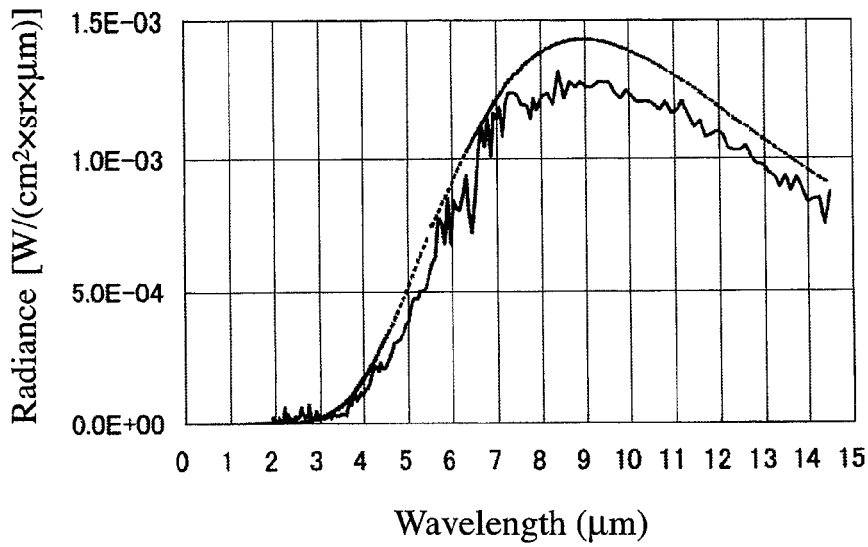
FIG. 7 is a graph showing the far-infrared radiance of the sample of Comparative Example 2 and an ideal black body.
Figure 8:
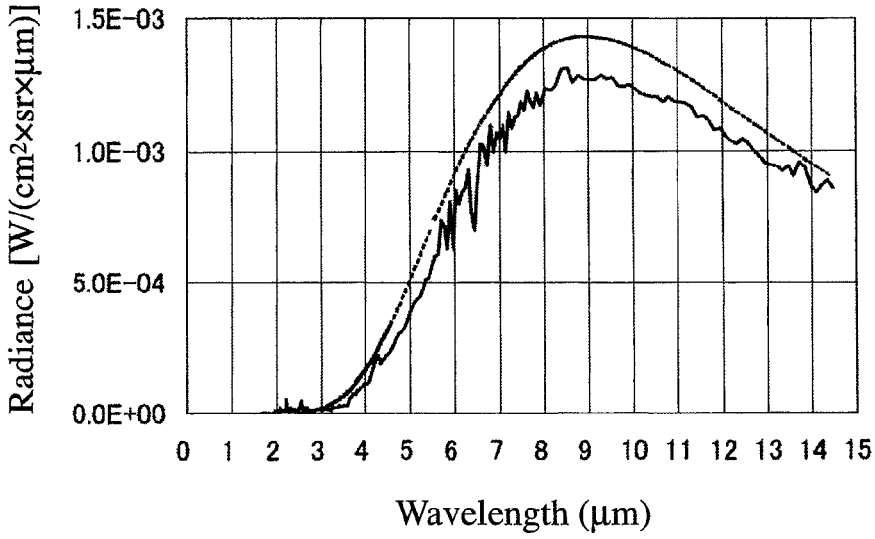
FIG. 8 is a graph showing the far-infrared radiance of the sample of Comparative Example 3 and an ideal black body.
Figure 9:
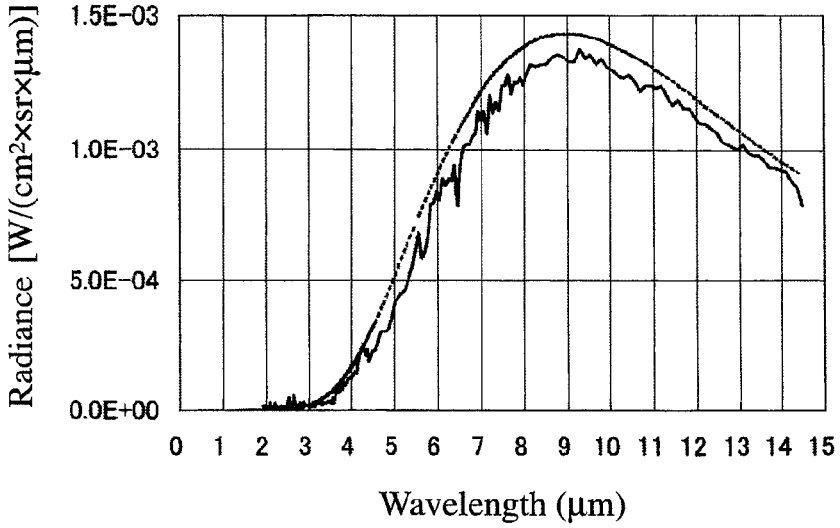
FIG. 9 is a graph showing the far-infrared radiance of the sample of Comparative Example 4 and an ideal black body.
Figure 10:
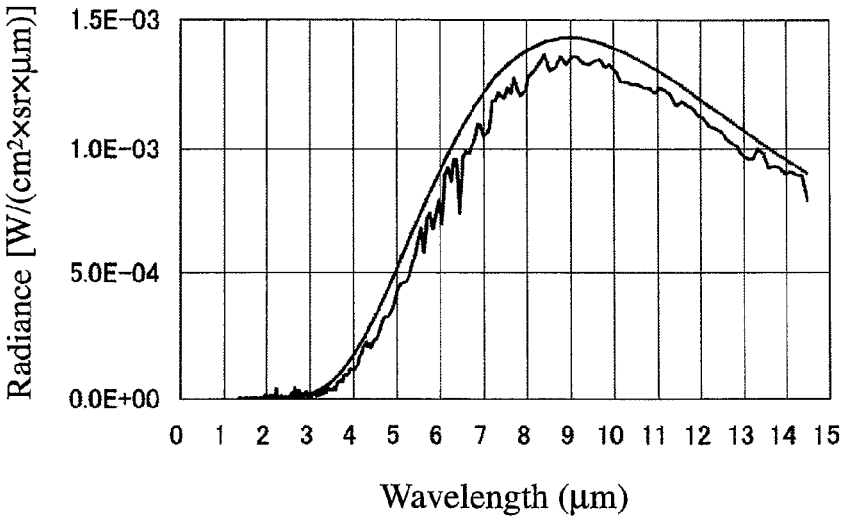
FIG. 10 is a graph showing the far-infrared radiance of the sample of Comparative Example 5 and an ideal black body.

[1] Fibers Containing Nano-Sized Diamond and Platinum Nanocolloid

The fibers of the present invention are obtained by attaching a dispersion of nano-sized diamond and platinum nanocolloid to the fibers by spraying, padding, printing, coating, immersion, etc., and drying them at room temperature or by heating. The concentrations of the nano-sized diamond and the platinum nanocolloid in the dispersion are not particularly restrictive, but each concentration is preferably 1% or less, more preferably 0.1% or less. The dispersion of nano-sized diamond and platinum nanocolloid may contain dispersants, binders, thickeners, etc., if necessary, but their amounts are preferably as small as possible because they hinder far-infrared radiation. The binders may be acrylic resins, urethane resins, silicone resins, aminoplast resins, epoxy resins, etc. Among them, the acrylic resins and the urethane resins are preferable from the aspect of washing durability. The dispersants may be polyacrylic acid and inorganic dispersants. The thickeners may be polyvinyl alcohol, methylcellulose, carboxymethylcellulose, hydroxyethylcellulose, etc.

The nano-sized diamond and the platinum nanocolloid can be attached to any fibers, which have conventionally been used. For instance, they include cellulose fibers such as cotton; synthetic fibers such as nylon (registered trademark), polyesters, acrylics, polyethylene, polypropylene, etc.; regenerated fibers such as Bemberg, rayons; and protein fibers such as wool, silk, etc. These fibers may be used alone, or two or more of them may be spun, woven, twisted or knitted together. These fibers may be used in any form of filaments, staples, knits, fabrics, nonwoven fabrics, sewn fabrics, etc.

The nano-sized diamond and the platinum nanocolloid can also be added to fibers by dispersing them in a spinning solution and then spinning the solution according to a usual method. The usable polymer materials include thermoplastic resins such as polyesters, polyethylene, polypropylene, polystyrene, polycarbonates, polyurethanes, acrylic resins; thermosetting resins such as epoxy resins, melamine resins, urea resins, etc., rubbers such as natural rubbers, synthetic rubbers, etc.; and regenerated resins such as rayons, etc.

The fibers of the present invention can be produced by a method of attaching the dispersion to the fibers, or by a method of mixing it into the spinning solution, but a dispersion-attaching method is preferable because it provides the fibers with better far-infrared radiation properties, and because it can be used for any fibers.

The amounts of the nano-sized diamond and the platinum nanocolloid used are not particularly restricted, as long as the far-infrared radiation effect is sufficiently obtained. Although the addition of only nano-sized diamond provides a far-infrared radiation effect to some extent, the addition of a small amount of the platinum nanocolloid to the nano-sized diamond extremely increases the far-infrared radiation effect. To obtain a sufficient far-infrared radiation effect, 0.01 mg or more of the nano-sized diamond is added to 1 kg of the fibers, and 0.0001 mg or more of the platinum nanocolloid is added to 1 kg of the fibers. The amount of the nano-sized diamond added to 1 kg of fibers is preferably 0.1 mg or more, more preferably 1 mg or more, most preferably 3 mg or more. The amount of the platinum nanocolloid added to 1 kg of fibers is preferably 0.001 mg or more, more preferably 0.01 mg or more, most preferably 0.03 mg or more. Because the addition of excessive nano-sized diamond and platinum nanocolloid does not result in the deteriorated far-infrared radiation, their upper limits are not particularly restricted. However, the amount of nano-sized diamond added is preferably 1 g or less, more preferably 0.1 g or less, most preferably 0.01 g or less, and the amount of platinum nanocolloid added is preferably 10 mg or less, more preferably 1 mg or less, most preferably 0.1 mg or less, from the aspect of cost and coloring. The amount of platinum nanocolloid that can effectively increase the far-infrared radiation of nano-sized diamond is preferably 1/1000 to 1/1, more preferably 1/1000 to 1/5, most preferably 1/500 to 1/10, particularly 1/200 to 1/20, of the amount of the nano-sized diamond.

In addition to the nano-sized diamond and the platinum nanocolloid, alumina, silica, titanium dioxide, magnesia, calcium oxide, zirconia, chromium oxide, ferrite, spinel, boron carbide, silicon carbide, titanium carbide, molybdenum carbide, tungsten carbide, boron nitride, aluminum nitride, silicon nitride, zirconium nitride, carbon, graphite, tungsten, molybdenum, vanadium, tantalum, manganese, nickel, iron oxide, etc. may be optionally add as far-infrared-radiating compounds. The amount of the optional component is not particularly restricted, but preferably 1-15% by weight, more preferably 2-10% by weight, based on the total amount of far-infrared-radiating particles. Their particle sizes are not particularly restricted either, but preferably 0.1-15 μm, more preferably 0.1-5 μm most preferably 0.2-1.5 μm.

The fibers containing nano-sized diamond and platinum nanocolloid can be used not only as temperature-keeping goods for bedding (futon, sheets, etc.), etc., but also for clothing (gloves, socks, underwear, hats, stomach bands, overcoats, inner soles, etc.), interior products (carpets, etc.), electric appliances and other industrial materials, etc.

[2] Nano-Sized Diamond (1) Coarse Diamond

Usable as the nano-sized diamond are coarse diamond (called "blended diamond" or "BD" below) synthesized by an explosion method, and ultra-dispersed diamond (UDD) obtained by the purification of BD. The explosion method is described in Science, Vol. 133, No. 3467 (1961), pp. 1821-1822, JP 1-234311 A, JP 2-141414 A, Bull. Soc. Chem. Fr. Vol. 134 (1997), pp. 875-890, Diamond and Related materials Vol. 9 (2000), pp. 861-865, Chemical Physics Letters, 222 (1994), pp. 343-346, Carbon, Vol. 33, No. 12 (1995), pp. 1663-1671, Physics of the Solid State, Vol. 42, No. 8 (2000), pp. 1575-1578, K. Xu. Z. Jin, F. Wei and T. Jiang, Energetic Materials, 1, 19 (1993), JP 63-303806 A, JP 56-26711 A, British Patent 1154633, JP 3-271109 A, JP 6-505694 A (WO 93/13016 A), Carbon, Vol. 22, No. 2, pp. 189-191 (1984), Van Thiei. M. & Rec., F. H., J. Appl. Phys. 62, pp. 1761-1767 (1987), JP 7-505831 A (WO 94/18123 A), and U.S. Pat. No. 5,861,349, etc.

The coarse diamond (blended diamond, BD) produced by the explosion method is composed of diamond and graphite as large as several tens of nanometers to several hundreds of nanometers, which is strong aggregate of nano-cluster-sized diamond units (nano-sized diamond) as extremely small as 1.7-7 nm in diameter. It is strong aggregate of at least 4 nano-sized diamonds, usually ten-odd to several hundreds of nano-sized diamonds, and several thousands of nano-sized diamonds in some cases. It is considered that a BD particle has a core/shell structure in which diamond is covered with graphite. Because the graphite surface has many hydrophilic functional groups such as —COOH, —OH, etc., it has extremely high affinity for solvents containing —OH groups such as water, alcohols, ethylene glycol, etc., thereby being easily dispersed in such solvents. Among them, it has the highest dispersibility in water. The BD contains trace amounts of amorphous diamond particles, graphite particles, and ultrafine, non-graphite carbon particles, as small as 1.5 nm or less.

The density of the nano-sized diamond particles is preferably 2.50-3.45 g/cm$^3$, more preferably 2.63-3.38 g/cm$^3$, most preferably 2.75-3.25 g/cm$^3$. The density of the nano-sized diamond is determined by a ratio of graphite to diamond. Calculating the ratio of diamond to graphite assuming that the diamond has a density of 3.50 g/cm$^3$, and the graphite has a density of 2.25 g/cm$^3$, the density of 2.63 g/cm$^3$ corresponds to a composition of 30% by volume of diamond and 70% by volume of graphite, and the density of 3.38 g/cm$^3$ corresponds to a composition of 90% by volume of diamond and 10% by volume of graphite. Similarly, the density of 2.75 g/cm$^3$ corresponds to a composition of 40% by volume of diamond and 60% by volume of graphite, and the density of 3.25 g/cm$^3$ corresponds to a composition of 80% by volume of diamond and 20% by volume of graphite. The density of 2.87 g/cm$^3$ corresponds to a composition of 50% by volume of diamond and 50% by volume of graphite. When the density is less than 2.63 g/cm$^3$, coloring due to graphite is likely serious, and when the density exceeds 3.38 g/cm$^3$, the far-infrared radiation effect is saturated, resulting in cost disadvantage.

Impurities in BD include (i) water-soluble (ionized) electrolytes, (ii) hydrolyzable groups and ionic materials (salts of functional surface groups, etc.) chemically bonded to the diamond surface, (iii) water-insoluble materials (impurities, insoluble salts and insoluble oxides attached to the surface), (iv) volatile materials, (v) materials contained in a diamond crystal lattice, or encapsulated materials.

The materials (i) and (ii) are formed in the purification process of UDD. The water-soluble electrolytes (i) can be washed away with water, but it is preferable to treat them with ion-exchange resins for more effective removal. The water-insoluble impurities (iii) are separate fine particles of metals, metal oxides, metal carbides or metal salts (sulfates, silicates or carbonates), or inseparable salts or metal oxides on the surface. To remove them, it is preferable to turn them soluble by acids. The volatile impurities (iv) can usually be removed by a heat treatment at 250-400° C. in vacuum of about 0.01 Pa.

Although the impurities need not necessarily be removed completely from the nano-sized diamond used in the present invention, it is preferable to remove 40-95% of the impurities (i) to (iii). The ratio of graphite to diamond can be adjusted by changing the explosion conditions and/or by changing the purification conditions of BD.

(2) Purification of Nano-Sized Diamond

A dispersion of nano-sized diamond is produced by subjecting early-stage BD (mixture of diamond and non-diamond just obtained by the explosion of an explosive) to an oxidation treatment, and neutralizing it with a basic material, which is volatile or whose decomposition product is volatile, to isolate a phase containing diamond.

The oxidation treatment comprises an oxidative decomposition treatment with nitric acid, and a subsequent oxidative etching treatment with nitric acid. The oxidative etching treatment comprises a first oxidative etching treatment and a second oxidative etching treatment. The first oxidative etching treatment is preferably conducted at higher pressure and temperature than those in the oxidative decomposition treatment, and the second oxidative etching treatment is preferably conducted at higher pressure and temperature than those in the first oxidative etching treatment. The oxidation treatment is preferably conducted plural times each at 150-250° C. and 14-25 atm for at least 10-30 minutes.

After the oxidative etching treatment, a neutralization treatment is conducted to decompose and remove nitric acid. The dispersion neutralized with a basic material is subjected to decantation to separate a phase containing diamond from a phase containing no diamond.

The separated diamond-containing dispersion phase is further washed with nitric acid to separate a lower dispersion phase containing the resultant fine diamond particles from a supernatant phase. This separation treatment is conducted by leaving the dispersion washed with nitric acid to stand.

The pH of the lower dispersion phase containing fine diamond particles is adjusted to preferably 4-10, more preferably 5-8, most preferably 6-7.5, and the concentration of fine diamond particles is adjusted to preferably 0.05-16% by mass, more preferably 0.1-12% by mass, most preferably 1-10% by mass.

The UDD thus obtained has an element composition comprising 72-89.5% of carbon, 0.8-1.5% of hydrogen, 1.5-2.5% of nitrogen, and 10.5-25% of oxygen. 90-97% of all the carbon is in the form of a diamond crystal, 10-3% being non-diamond carbon. The average particle size of primary particles is 2-50 nm. Its X-ray diffraction spectrum (XD) with a Ka line of Cu has the strongest peak at a Bragg angle (20±0.2°) of 43.9° , strong characteristic peaks at 73.5° and 95° , a halo at 17° , and substantially no peak at 26.5° . The UDD has a specific surface area of 1.5×105 m$^2$/kg or more, substantially all carbon atoms on the surface being bonded to hetero atoms. The dispersion contains 0.05-16 parts by mass of diamond particles having a total pore volume of 0.5 m$^3$/kg or more. The particle size of the UDD particles is measured by dynamic light scattering using an electrophoretic, light-scattering photometer ELS-8000.

The particle size of the nano-sized diamond preferably used in the present invention is 4-7 nm for primary particles, and 50-200 nm for secondary particles.

[3] Platinum Nanocolloid

The platinum nanocolloid can be produced by the method described in WO 2005/023468. It is commercially available, for instance, as WRPT of Wineredchemical Co., Ltd. Though not particularly restricted, the particle size of platinum is preferably 10-20 nm.

[4] Evaluation of Far-Infrared Radiation

The far-infrared radiation is evaluated by measuring the amount of far-infrared rays emitted from a sample by an infrared meter such as FT-IR, a radiance meter, etc., and determining its relative value to the far-infrared radiation from an ideal black body having 100% radiation and absorption in the entire wavelength. Measurement can be conducted at room temperature, but to prevent an S/N ratio from being deteriorated by $CO_2$ and $H_2O$ absorbing far-infrared rays, the sample is preferably heated at 40-50° C. High-temperature measurement improves the S/N ratio because of increase in the far-infrared radiation. An infrared-measuring apparatus may be, for instance, an infrared radiation meter SA-200 available from Minarad System, Inc.

The present invention will be described in detail with reference to Examples below without intension of limitation.

Example 1

After 0.65 kg of an explosive comprising trinitrotoluene (TNT) and cyclotrimethylenetrinitroamine (RDX) at a ratio of 60/40 was exploded in a 3-m$^3$-explosion chamber to provide an atmosphere for keeping the resultant BD, second explosion was conducted under the same conditions to synthesize the BD. After the expanded explosion product reached a thermal equilibrium, a gas mixture was caused to flow out of the chamber for 35 seconds through an ultrasonic Laval nozzle having a cross section of 15 mm. Because of heat exchange with a chamber wall and work conducted by the gas (adiabatic expansion and vaporization), the cooling speed of the product was 280° C./minute. The product (black powder, BD) collected by a cyclone had a density of 2.58 g/cm$^3$. It was calculated from the density that this BD was composed of 74% by volume of graphite and 26% by volume of diamond.

This BD was mixed with a 60-%-by-mass aqueous nitric acid solution, subjected to oxidative decomposition at 160° C. and 14 atm for 20 minutes, and then subjected to oxidative etching at 240° C. and 18 atm for 30 minutes. The oxidation-etched sample was neutralized by reflux at 210° C. and 20 atm for 20 minutes, decanted, washed with 35-%-by-mass nitric acid, centrifugally separated, and subjected to concentration adjustment to obtain a purified dispersion containing 0.05% by mass of nano-sized diamond. This nano-sized diamond had a particle size (median diameter measured by dynamic light scattering) of 160 nm and a specific gravity of 3.41.

The platinum nanocolloid used was WRPT (0.0025-%-by-mass dispersion of platinum nanocolloid) available from Wineredchemical Co., Ltd. This platinum nanocolloid had a particle size (median diameter) of 20 nm when measured by dynamic light scattering.

The nano-sized diamond dispersion and the platinum nanocolloid dispersion were mixed and diluted to prepare a mixture dispersion containing 0.1 mg of nano-sized diamond and 0.001 mg of platinum nanocolloid per 20 mL. 20 mL of this mixture dispersion was uniformly attached to 30 g of a polyester fiber wad by a spraying method, and spontaneously dried. The dried wad was set in a holder, and kept at a surface temperature of 46° C. while heating its rear side by a drier. In this state, far-infrared radiation from a front surface of the wad was measured by an infrared radiation meter SA-200 available from Minarad System, Inc. The emissivity [relative intensity per radiation (1.0) from an ideal black body] of the wad at a wavelength of 3-15 μm was determined from the measured far-infrared radiation. The results are shown in Table 1. The far-infrared radiance (the amount of far-infrared radiation) of the sample of Example 1 is shown in FIG. 1. FIG. 1 shows the measured data 2 of the sample (line with noise) together with the radiation 1 (smooth curve) of the ideal black body, indicating that the closer to the ideal black body, the more far-infrared rays radiated. However, the far-infrared radiance of the sample never exceeds that of the ideal black body.

Examples 2-5 and Comparative Examples 1-5

Samples were produced in the same manner as in Example 1 except for changing the amounts of the nano-sized diamond and/or the platinum nanocolloid in 20 mL of the mixture dispersion as shown in Table 1, and their far-infrared radiation was measured to determine emissivity at a wavelength of 3-15 μm. Comparative Example 1 used a polyester fiber wad to which the nano-sized diamond and/or the platinum nanocolloid were not attached. The results are shown in Table 1. FIGS. 2-10 show the measured far-infrared radiance (the amount of far-infrared radiation) of Examples 2-5 and Comparative Examples 1-5. The notes of the data are the same as in FIG. 1.

TABLE 1

| No. | Amount (mg) per 20 mL of Mixture Dispersion | | Amount (mg) per 1 kg of Wad | | |
|---|---|---|---|---|---|
| | Nano-Sized Diamond | Platinum Nanocolloid | Nano-Sized Diamond | Platinum Nanocolloid | Far-Infrared Emissivity(1) |
| Example 1 | 0.1 | 0.001 | 3.3 | 0.033 | 0.83 |
| Example 2 | 0.1 | 0.005 | 3.3 | 0.17 | 0.85 |
| Example 3 | 0.5 | 0.015 | 17 | 0.50 | 0.95 |
| Example 4 | 0.5 | 0.025 | 17 | 0.83 | 0.93 |
| Example 5 | 10 | 0.5 | 330 | 17 | 0.84 |
| Comparative Example 1 | No(2) | No(2) | No(2) | No(2) | 0.61 |
| Comparative Example 2 | 0 | 0.001 | 0 | 0.033 | 0.68 |
| Comparative Example 3 | 0 | 0.015 | 0 | 0.500 | 0.69 |
| Comparative Example 4 | 0.1 | 0 | 3.3 | 0 | 0.78 |
| Comparative Example 5 | 0.5 | 0 | 17 | 0 | 0.77 |

Note:
(1)Radiation at a wavelength of 3-15 μm relative to that from an ideal black body.
(2)A polyester fiber wad before attaching nano-sized diamond and/or platinum nanocolloid was used.

It is clear from Table 1 that the polyester wads having nano-sized diamond and platinum nanocolloid attached, which corresponded to the fibers of the present invention, had far-infrared emissivity of 0.83 or more, much higher than 0.61 of the sample having no nano-sized diamond and platinum nanocolloid attached (Comparative Example 1). When only the platinum nanocolloid was attached (Comparative Examples 2 and 3), and when only the nano-sized diamond was attached (Comparative Examples 4 and 5), the far-infrared emissivity was improved to some extent than in the sample having nothing attached (Comparative Example 1), but it was found that the attachment of both nano-sized diamond and platinum nanocolloid remarkably improved the far-infrared emissivity. Particularly the samples of Examples 3 and 4 had far-infrared emissivity exceeding 0.9, indicating excellent far-infrared radiation.

Example 6

The mixture dispersion produced in Example 1, which contained 0.1 mg of nano-sized diamond and 0.001 mg of platinum nanocolloid per 20 mL, was added at 20° C. to a viscose solution comprising 8.5% by mass of cellulose, 5.8% by mass of sodium hydroxide, and 32% by mass of carbon disulfide per the cellulose, in an amount of 66.7 mL per 100 g of the cellulose. This viscose solution containing nano-sized diamond and platinum nanocolloid was spun in a spinning bath (60° C.) containing 110 g/L of sulfuric acid, 15 g/L of zinc sulfate and 350 g/L of sodium sulfate at a spinning speed of 50 m/minute and a draw ratio of 50%, to obtain a tow of viscose rayon fibers having fineness of 1.7 dtex. The fibers were cut to 52 mm, desulfurized and bleached.

Examples 7-10

Tows of viscose rayon fibers of Examples 7-10 were produced in the same manner as in Example 6, except for changing the amounts of nano-sized diamond and platinum nanocolloid added. The amounts of nano-sized diamond and platinum nanocolloid per the fibers of Examples 7-10 were the same as those per the wad fibers in Examples 2-5.

The same far-infrared emissivity measurement as in Example 1 revealed that the viscose rayon fibers of Examples 6-10 exhibited excellent far-infrared radiation as in Examples 1-5.

Examples 11-15

Various nano-sized diamonds with different densities were produced in the same manner as in Example 1 except for changing only the oxidative etching conditions in the purification of BD as shown in Table 2, and polyester fiber wads to which nano-sized diamond and platinum nanocolloid were attached were obtained. The same far-infrared emissivity measurement as in Example 1 revealed that these polyester fiber wads exhibited excellent far-infrared radiation as in Examples 1-5.

TABLE 2

| No. | Oxidation Etching Conditions | Density ($g/cm^3$) |
|---|---|---|
| Example 1 | 240° C., 18 atm, 30 minutes | 3.41 |
| Example 11 | 130° C., 13 atm, 1 hour | 2.63 |
| Example 12 | 130° C., 13 atm, 2 hours | 2.75 |
| Example 13 | 150° C., 13 atm, 1 hour | 2.87 |
| Example 14 | 150° C., 13 atm, 2 hours | 3.25 |
| Example 15 | 240° C., 18 atm, 20 minutes | 3.38 |

Example 16

A polyester fiber wad to which nano-sized diamond and platinum nanocolloid were attached was produced by the same method as in Example 3, to produce bedding. Using this bedding, 20 examinees (male: 10, and female: 10) slept one night in a constant-temperature, constant-humidity room at 15° C. and 60% RH, to evaluate the warming effect. For comparison, the same test was conducted with bedding produced using a polyester fiber wad to which nano-sized diamond and platinum nanocolloid were not attached. As a result, 17 examinees (male: 8, and female: 9) among 20 enjoyed more comfortable sleep with a higher warming effect, in the case of the beddingproduced by the polyester fiber wad of the present invention to which nano-sized diamond and platinum nanocolloid were attached.

EFFECT OF THE INVENTION

Because the fibers of the present invention containing nano-sized diamond and platinum nanocolloid have excellent far-infrared radiation, they are suitable for temperature-keeping goods such as bedding, winter clothes, supporters, etc.

What is claimed is:

1. A material comprising fibers having excellent temperature-keeping properties, said fibers comprising 0.01 mg or more and 1 g or less of nano-sized diamond and 0.0001 mg or more and 10 mg or less of platinum nanoparticles per 1 kg of said fibers, wherein said nano-sized diamond is obtained by an explosion method, wherein said nano-sized diamond and said platinum nanoparticles are sparsely attached to the fibers, wherein said fibers are obtained by attaching a dispersion of nano-sized diamond and platinum nanoparticles to the fibers only by spraying, padding, printing, coating or immersion, and drying the fibers, wherein the nano-sized diamond and platinum nanoparticles are impregnated onto the fibers.

2. The material according to claim 1, containing 3 mg or more of said nano-sized diamond and 0.03 mg or more of said platinum nanoparticles per 1 kg of said fibers.

3. The material according to claim 1, containing 0.1 g or less of said nano-sized diamond and 1 mg or less of said platinum nanoparticles per 1 kg of said fibers.

4. The material according to claim 1, wherein the platinum nanoparticles content is 1/1000 to 1/1 of the nano-sized diamond content.

5. The fibers material according to claim 1, wherein said nano-sized diamond has a density of 2.63-3.38 $g/cm^3$.

6. Bedding formed by the material recited in claim 1.

* * * * *